US010074264B2

(12) United States Patent
Marra et al.

(10) Patent No.: US 10,074,264 B2
(45) Date of Patent: Sep. 11, 2018

(54) SYSTEM AND METHOD OF MONITORING PHYSICAL CONTACT EVENTS IN A HOSPITAL ENVIRONMENT

(71) Applicants: Sociedade Beneficente Israelita Brasileira Hospital Albert Einstein, São Paulo (BR); I-HealthSys Produtos Médicos Ltda—ME, São Carlos (BR)

(72) Inventors: Alexandre Rodrigues Marra, Sao Paulo (BR); Oscar Fernando Pavao Dos Santos, Sao Paulo (BR); Marcelo Prado, Sao Carlos (BR); Renaldo Massini Junior, Sao Carlos (BR); Tales Roberto De Souza Santini, Muzambinho (BR); Alvaro Costa Neto, Sao Carlos (BR)

(73) Assignees: Sociedade Beneficente Israelita Brasileira Hospital Albert Einstein, São Paulo (BR); I-HealthSys Produtos Médicos Ltda—ME, São Carlos (BR)

( * ) Notice: Subject to any disclaimer, the term of this patent is extended or adjusted under 35 U.S.C. 154(b) by 0 days.

(21) Appl. No.: 15/440,911

(22) Filed: Feb. 23, 2017

(65) Prior Publication Data

US 2018/0144609 A1 May 24, 2018

(30) Foreign Application Priority Data

Nov. 22, 2016 (BR) ..... 102016027362

(51) Int. Cl.
*G08B 21/24* (2006.01)
*G08B 7/06* (2006.01)

(52) U.S. Cl.
CPC ..... *G08B 21/245* (2013.01); *G08B 7/06* (2013.01)

(58) Field of Classification Search
CPC ..... G08B 21/245; G08B 7/06
See application file for complete search history.

(56) References Cited

U.S. PATENT DOCUMENTS

| | | | | |
|---|---|---|---|---|
| 6,727,818 | B1 * | 4/2004 | Wildman | G06F 19/3418 340/10.1 |
| 9,189,950 | B2 * | 11/2015 | Best | G08B 21/245 |
| 9,227,024 | B2 * | 1/2016 | Deutsch | A61M 5/5086 |
| 9,330,287 | B2 * | 5/2016 | Graczyk | G06K 7/10099 |
| 2004/0090333 | A1 * | 5/2004 | Wildman | G06F 19/3418 340/573.1 |
| 2010/0073162 | A1 * | 3/2010 | Johnson | G08B 21/245 340/540 |
| 2012/0268277 | A1 * | 10/2012 | Best | G08B 21/245 340/573.1 |
| 2012/0316497 | A1 * | 12/2012 | Deutsch | A61M 5/5086 604/111 |

(Continued)

*Primary Examiner* — Nay Tun
(74) *Attorney, Agent, or Firm* — Patterson + Sheridan, LLP

(57) ABSTRACT

Disclosed is a monitoring system of physical contact events in a hospital environment), wherein the hospital environment comprises at least one operable device by a passer-by in the hospital environment, the system comprising:
at least one touch sensor associated with a surface of the operable device, the touch sensor configured in order to identify the occurrence of a physical contact on the surface of the operable device. A method of monitoring physical contact events in a hospital environment is also disclosed.

18 Claims, 8 Drawing Sheets

(56) References Cited

U.S. PATENT DOCUMENTS

| | | | | |
|---|---|---|---|---|
| 2013/0229263 | A1* | 9/2013 | Graczyk | G01S 1/70 340/10.1 |
| 2016/0103500 | A1* | 4/2016 | Hussey | G06F 3/046 345/173 |
| 2017/0032656 | A1* | 2/2017 | Morgan | G08B 21/245 |

* cited by examiner

SYSTEM AND METHOD OF MONITORING PHYSICAL CONTACT EVENTS IN A HOSPITAL ENVIRONMENT

The present invention relates to a system and method of monitoring physical contact events in a hospital environment. More specifically, to a system and method capable of indicating to the healthcare professional or a visitor to a hospital environment the need to perform hand hygiene.

DESCRIPTION OF THE PRIOR ART

Hand hygiene is common and required practice in hospitals for both healthcare professionals and patients/caregivers, and is obviously aimed at preventing or at least reducing the transmission of diseases and infections.

For this reason, in a hospital, a plurality of dispensers are arranged, most of which comprises alcohol gel so that the passers-by have the opportunity to perform the correct hand hygiene. In addition to the said dispensers, it is of course possible to carry out the hygiene through taps arranged inside the hospitals.

Hygiene care is more distinct within surgical centers, since in these places the interaction between the patient and the healthcare professional is the highest possible, as well as the interaction between the healthcare professional and equipment, utensils, objects, furniture, which may be contaminated.

In addition, infection rates are considerable during invasive procedures in Intensive Care Units (ICUs); thus, hygiene care should also be intensified during such actions.

For these reasons, it is common and increasing the search for means of reducing or avoiding the contamination of the hands and consequently to ensure that the healthcare professionals carry out the hygiene in the so-called five moments for hand hygiene.

One of the means used to prevent contamination of the hands is the use of devices that can be operated by gestures, thus avoiding the occurrence of touches in said device.

As an example, one may cite the matter disclosed in U.S. Pat. No. 8,409,095, in which it proposes a device for driving hospital equipment without the need for operator touch to actuate it.

Basically, the user of said device can perform gestures to, for example, increase or decrease a certain magnitude or to turn the device on or off.

Additionally, document US 2008/0018598 describes a monitor control system without the need for a user to touch it. To this end, the system uses motion sensors and an infrared element.

More specifically, document US 2008/0018598 proposes a system for controlling a monitor pointer without the need for a user to touch it, wherein the motion sensor is positioned next to the computer (monitor) and emits a light beam at the infrared wavelength, said beam being reflected by a reflector instrument used by the user. Finally, the motion sensor converts the movement of the instrument into an electrical signal for control of the monitor pointer.

Another gesture-operable device is disclosed in document US 2015/0062073, which describes the proposal of an interactive terminal, such as a display used in a surgical center and which does not require physical contact of the user to operate it. As an example, the configuration in which said terminal can illustrate a checklist for the surgeon during the surgical procedure is mentioned.

Although effectively contributing to the reduction in the transmission of hospital-acquired infections, prior art devices fail to provide means of verification that the protocol required by said touchless devices has been effectively followed by the healthcare professional.

More specifically, there is not in the prior art a proposal that evaluates whether a physical contact between the healthcare professional and the device (touchless device) has unduly occurred and that, as a consequence, the safety protocol (operating the device without touching it) was violated.

Thus, it is observed that the state of the art focuses on the proposal of reducing physical contact between doctor and equipment, but fails to provide means that indicate to the physician that a physical contact has unduly occurred and that, consequently, the hygiene of the hands is necessary.

Therefore, the present invention describes a system and method for monitoring physical contact events in a hospital environment, more specifically, a system and a method preferably applicable to a surgical center, as well as to an Intensive Care Unit (ICU) and that detect the occurrence of undue physical contact with a device, recording such occurrence, as well as its history, and indicating to the healthcare professional the need for hand hygiene.

Similarly, the system and method proposed in the present invention are applicable to other locations in a hospital environment, such as to detect, for example, the occurrence of undue physical contact by a hospital visitor with a device, recording such occurrence, as well as the history thereof, and indicating to the visitor the need for hand hygiene.

It is further understood that the present invention is capable of detecting the occurrence of undue physical contact in equipment such as furniture, terminals, monitors, beds, or any other components and surfaces arranged in the hospital environment (thereby enhancing the need for hand hygiene in the so-called fifth moment for hand hygiene, that is, after contact with areas close to the patient).

Thus, it should be emphasized that reference to devices should be understood as components arranged in the hospital environment (furniture, terminals, monitors, infusion pumps, among others).

OBJECTS OF THE INVENTION

The object of the present invention is to provide a system and method of monitoring physical contact events in a hospital environment.

The present invention also objects to provide a system and method capable of detecting the occurrence of an undue physical contact with a device operated by a passer-by in the hospital environment, by an operable device, preferably referring to an equipment (component) disposed in the hospital environment, such as infusion pumps, monitors, terminals, tables, chairs, among others.

It is a further object of the present invention the provision of a system and method capable of detecting the occurrence of an undue physical contact with a device operated by a healthcare professional, said operable device preferably disposed in a surgical center of the hospital environment. It is emphasized that by operable device is preferably understood as equipment (component) disposed in the hospital environment, such as infusion pumps, monitors, terminals, tables, chairs, among others.

It is a further object of the present invention to provide a system and method capable of generating a perceptible indication to the passer-by in the hospital environment from the occurrence of a physical contact with the operable device.

It is a further object of the present invention to provide a system and method capable of generating an event log from the occurrence of a physical contact between the operable device and the passer-by in the hospital environment.

Finally, the object of the present invention is to provide a method of monitoring physical contact events in a hospital environment in harmony with the proposed system.

BRIEF DESCRIPTION OF THE INVENTION

The objects of the present invention are achieved by means of a monitoring system of physical contact events in a hospital environment, wherein the hospital environment comprises at least one device operable by a passer-by in the hospital environment, and the system further comprises: at least one touch sensor associated with a surface of the operable device, the touch sensor configured in order to identify the occurrence of a physical contact on the surface of the operable device.

In addition, the objects of the invention are achieved by a method of monitoring physical contact events in a hospital environment, wherein the hospital environment comprises at least one device operable by a passer-by in the hospital environment. The method comprising the steps of: identifying the occurrence of a physical contact on the surface of the operable device and generating an extract of events at each occurrence of identified physical contact.

BRIEF DESCRIPTION OF THE DRAWINGS

The present invention will be further described in more detail based on one example of realization represented in the drawings. The figures show.

DETAILED DESCRIPTION OF THE FIGURES

Figure 1:
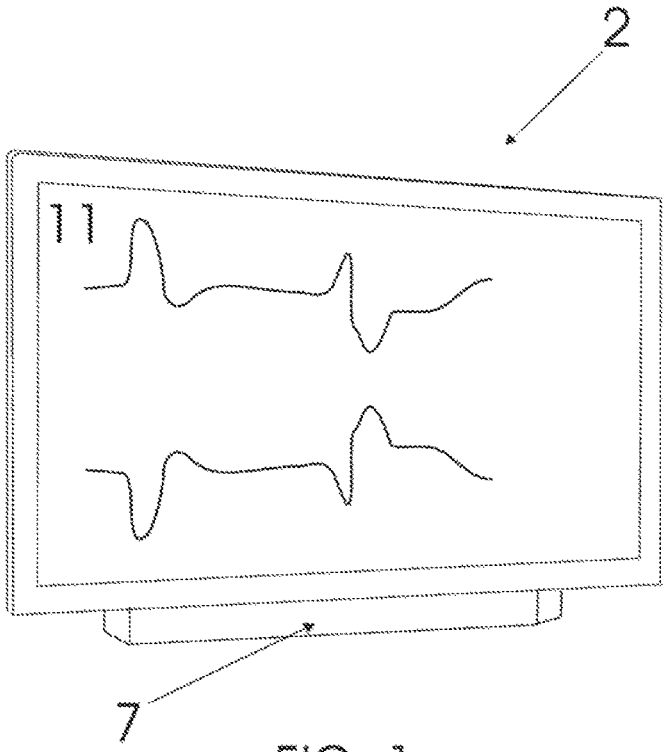
FIG. 1—is a perspective representation of a device operable by a healthcare professional.

The present invention discloses a monitoring system of physical contact events in a hospital environment 1, also referenced only as system 1. By hospital environment, it is to be understood as any health treatment location, such as a hospital, encompassing its corridors, elevators, bedrooms, rooms, feeding areas, hospitalization areas, intensive care areas, surgical centers, among others.

The hospital environment can also be interpreted as a nursing home, emergency care units, health posts, vaccination posts, emergency treatment stations, among others. Basically, any health treatment-related location is to be understood as the hospital environment described in the present invention.

As will be better discussed below, this preferred configuration of the monitoring system of physical contact events in a hospital environment will preferably refer to a surgical center of a hospital or an Intensive Care Unit (ICU) of this hospital.

In addition, the system 1 proposed in the present invention comprises at least one device operable by a passer-by in the hospital environment.

The reference to a passer-by in the hospital environment should be understood as any person who moves within the hospital environment, such as doctors, nurses, visitors, companions, outsourced professionals, among others.

Basically, anyone within the hospital environment should be understood as a passer-by in it.

This preferred embodiment of the present invention, by preferably addressing the hospital environment as the surgical center of a hospital or as the ICU thereof, preferably refers to the passer-by as a healthcare professional.

In addition, by operable device 2, it is understood as any device capable of being manipulated by the passer-by in the hospital environment, such as monitors, dispensers, information terminals, whether sensitive to the touch or not. Furthermore, the operable device 2 may be interpreted as any element arranged in the hospital environment, such as furniture (chairs, tables, stretchers, mattresses), scales, sinks, doors, among others.

Thus, the present invention, among other aspects, reinforces the need for hygiene in the so-called fifth moment for hand hygiene, that is, after contact with areas close to the patient, such as in objects, furniture or other surfaces in the vicinity of the patient.

In this preferred embodiment of the present invention, reference to an operable device 2 is to be understood as a monitor disposed in the surgical center or in the ICU of a hospital, more preferably, to a monitor operable by gestures, that is, touchless. Even more preferably, the monitor is configured as a multi-parameter monitor 13.

It is emphasized that the reference to a gesture-operable monitor refers only to a preferred feature of the present invention, such that the proposed system 1 is suitable for use in a touch-operable device 2. Similarly and as already described above, reference to the operable device 2 as a monitor should be considered only as a preferred feature of the present invention.

FIG. 1 is a preferred embodiment of an operable device 2 which preferably integrates the system 1 proposed in the present invention.

As mentioned above, said operable device 2 is configured as a monitor that operates by gestures, and can be used in surgical centers for examination analysis, video control, among other functionalities. It is then understood that the operable device 2 may preferably be configured as a multi-parameter monitor 13.

Even being operated by gestures, in some occasions the healthcare professional unduly ends up touching its surface 11, either by negligence, lack of custom or lack of knowledge of the operability of said monitor by means of gestures.

In order that any physical contacts on the surface 11 of the operable device 2 can be detected, the system proposed in the present invention comprises a touch sensor 3 associated with said surface 11.

Figure 2:
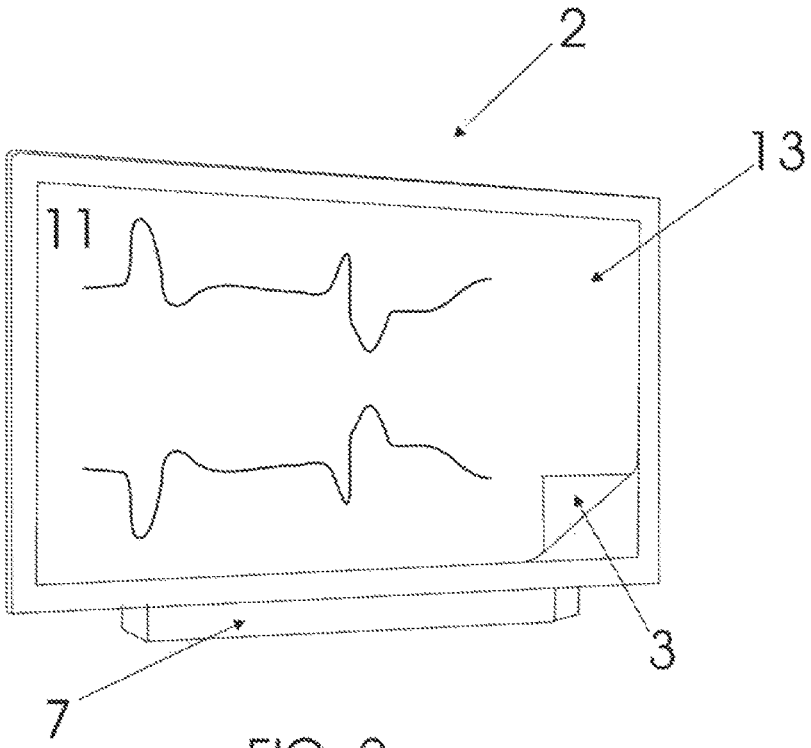
FIG. 2—is a perspective representation of a device operable by a healthcare professional wherein the device comprises a touch sensor.

As shown in FIG. 2, the touch sensor 3 is preferably configured as a film which is associated with the surface 11 of the operable device 2. In a preferred embodiment, said association occurs through an adhesive element arranged in the touch sensor 3.

In addition, the touch sensor 3 comprises a plurality of sensors, such as capacitive or resistive, and which are capable of detecting the occurrence of a touch on the sensor 3, as well as on the surface 11 of the operable device 2.

As also noted in FIG. 2, the system 1 proposed in the present invention further comprises a first identification sensor 7 associated with the operable device 2 and touch sensor 3.

With respect to the first identification sensor 7, it is preferably configured as a wireless communication module, such as a radio frequency module, which has the function of identifying the healthcare professional who makes physical contact (touch) with the surface 11 of the operable device 2.

Preferably, the first identification sensor 7 is configured with a Bluetooth, Zigbee, Wi-Fi sensor, or any other wireless communication module currently known in the prior art.

Figure 3:
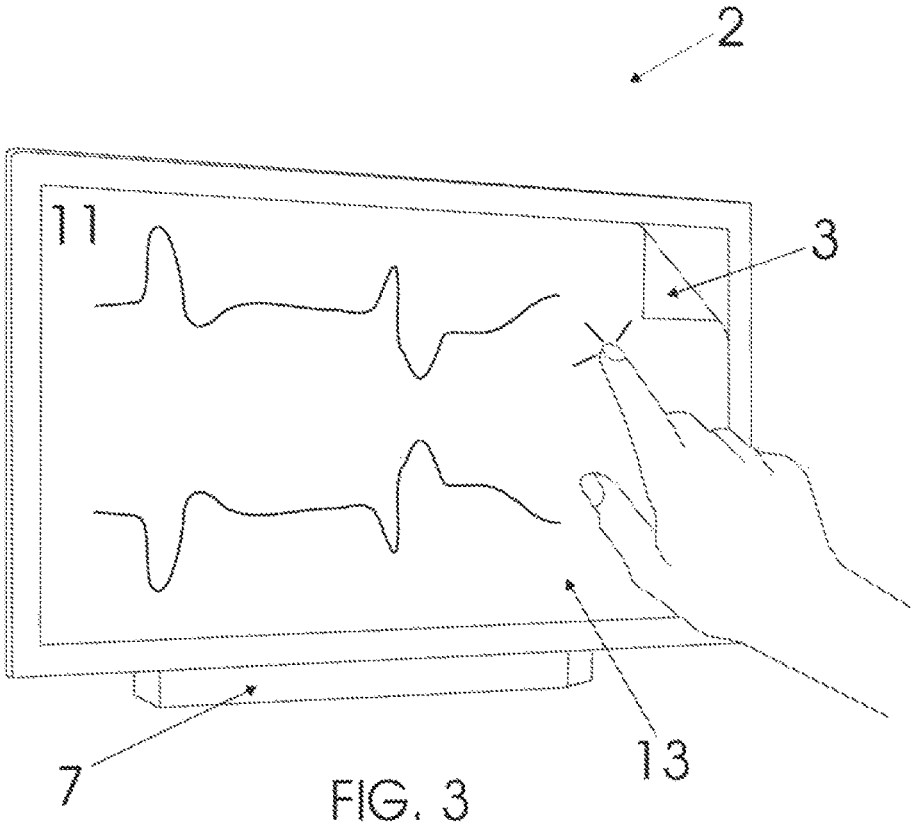
FIG. 3—is a further perspective representation of a device operable by a healthcare professional representing the occurrence of a physical contact on its surface.

Upon occurrence of a physical contact on the surface 11 of the operable device 2, as indicated in FIG. 3 by the hand of the healthcare professional, said action will be identified by the touch sensor 3.

Concurrently with the identification of the touch occurrence on the surface 11, the system 1 proposed in the present invention is apt to generate an event log 8 related to the physical contacts occurred.

Figure 4:
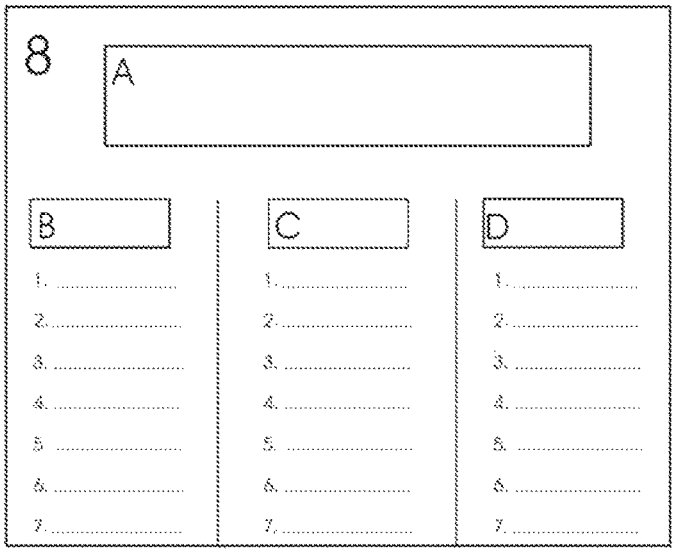
FIG. 4—is a representation of the event log generated from the occurrence of physical contact on the surface of the operable device.

More specifically with reference to FIG. 4, the event log 8 stores information related to the physical contact performed on a particular operable device 2 of a surgical center.

Thus, the event log 8 preferably comprises a first field A referring to a brief description of the operable device 2, such as "surgical center monitor—room 447", a second field B referring to the description of the touch event occurred, such as touch 1, touch 2, a third field C referring to the indication of the healthcare professional who made such touch, such indication being nominal, such as "Dr. John Smith" or through the registration number of the professional, and a fourth field D referring to the indication of the date and time the physical contact occurred.

Thus, from the event log 8 there is a listing of the physical contacts occurring for a particular operable device 2. In addition, the event log 8 of each operable device 2 of a hospital environment can be consolidated, thus generating a consolidated event log 8', as preferably shown in FIG. 5.

Thus, and using appropriate software, one can analyze touch events only for a given device operable to 2 and a plurality of beds in a hospital environment. Also, one can analyze touch events in a given period of time and related to a specific healthcare professional.

Accordingly, with the system 1 proposed in the present invention both the event log 8 and the consolidated event log 8' can be sent to a control center 9 of the hospital environment.

The reference to control center 9 can be understood as the management room of the hospital environment, as well as the control unit of a determined floor of the hospital.

Additionally, the event log 8 and the consolidated event log 8' may be sent to a remote device, such as a cellular device of the healthcare professional (or hospital manager) that performed the physical contact on the surface 11 of the operable device 2.

In addition to the possibility of generating the event log 8 and the consolidated event statement 8', the system 1 proposed in the present invention is still able to generate a perceptible indication 10 to the passer-by (healthcare professional) of the hospital environment.

In a first embodiment, the perceptible indication 10 may be represented as a luminous signal, preferably in red color, arranged in an identifying element 15 of the passer-by in the hospital environment. Further, the perceptible indication 10 could be represented as a text message or even a graphic, indicating to the healthcare professional that it should sanitize the hands.

Figure 6:
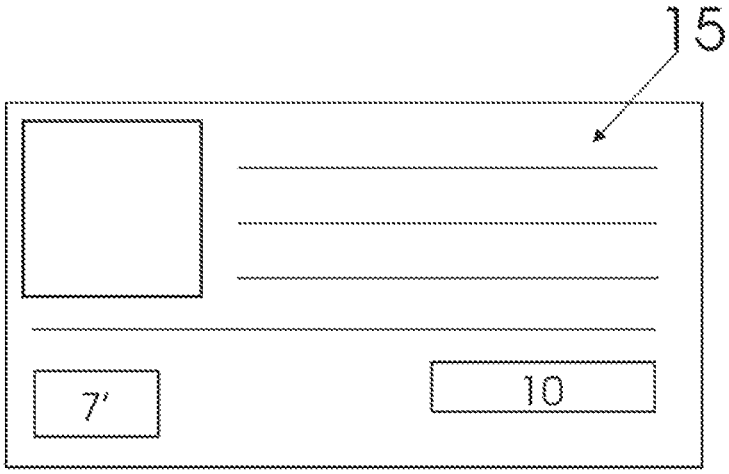
FIG. 6—is a representation of an identifying element of a passer-by in the hospital environment.

More specifically, and with reference to FIG. 6, a red light (perceptible indication 10) can be emitted on the badge (identifying element 15) of the healthcare professional to indicate that he/she touched the screen of the operable device 2 and that consequently hygiene of the hands should be performed.

Alternatively, the perceptible indication 10 may be configured as a vibrating or even audible alert emitted from the identifying element 15. The indication by means of images or texts on the identifying element 15 itself is also acceptable, as well as the representation encompassing the set of visual/sound/vibratory indications and through texts and images.

By way of example, the perceptible indication 10 could be indicated on the healthcare professional's identifying element 15 by means of a text message, such as: "hygiene of the hands required", "please sanitize your hands", "sanitation protocol violated", "remember the five moments for hand hygiene" or "fifth moment of hand hygiene violated".

Alternatively, the perceptible indication 10 could be emitted in the cellular apparatus of the healthcare professional, in this case, the cellular apparatus (provided with suitable application) will communicate, preferably via Bluetooth, with the first identification sensor 7 thus allowing not only the identification of the professional who touched the operable device 2, as well as the illustration of the perceptible indication 10.

The indication on the cell phone of the healthcare professional is also possible; in this case, the system 1 must comprise a communication module, preferably via Bluetooth, for communication with the cellular device.

Thus, it is understood that reference to the healthcare professional's identifying element 15 as a badge is to be understood only as a preferred description of the present invention, in alternative embodiments, the identifying element 15 could represent a tag, a bracelet, the healthcare professional's cell phone itself, or any component used by the hospital environment to identify the medical professional.

In addition, in order that the identification of the healthcare professional who has made the physical contact on the surface 11 of the operable device 2 be possible, as well as its representation in the third field C of the event log 8, the healthcare professional's identifying element 15 should preferably comprise a second identification sensor 7', which is compatible with the first identification sensor 7.

Thus, it is understood that the second identification sensor 7' is preferably configured as a radio frequency module capable of identifying the person who made the physical contact on the surface 11 of the operable device 2. Preferably, the second identification sensor 7' is configured as a Bluetooth sensor, Zigbee, Wi-Fi or any other wireless communication module currently known in the prior art.

If the medical professional is not using his identifying element 15 at the time the physical contact occurred, the touch indication will be generated and displayed in event log 8, but the indication of who made the physical contact will not be possible.

Alternatively to the indication in the identifying element 15 as preferably shown in FIG. 6, the system 1 proposed in the present invention is still able to indicate that a physical contact occurred on the surface 11 of the operable device 2 in a signaling element 16 of the hospital environment.

According to this preferred embodiment of the system 1 proposed in the present invention, the identifying element 16 is preferably disposed in the surgical center or in the ICU in which the healthcare professional manipulates the operable device 2.

Figure 7:
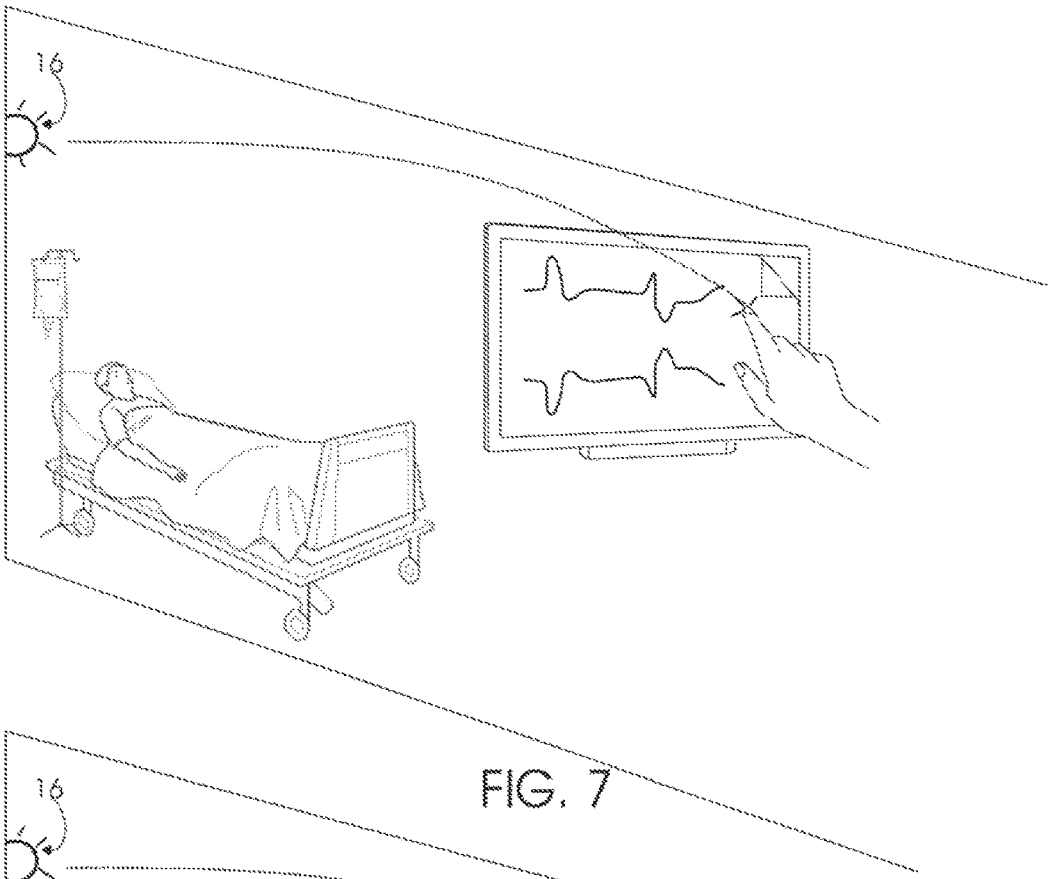
FIG. 7—is a representation, in a flag element, of the indication of physical contact in the operable device.

Preferably configured as a light representation, the signaling element 16 indicates in the surgical center that a physical contact occurred on the surface 11 of the operable device 2, as disclosed in FIG. 7.

Further, the perceptible indication 10 displayed on the signaling element 16 may be configured as a graphical interface, thereby displaying images or messages as: "hygiene of the hands required", "please sanitize your hands", "sanitation protocol violated", "remember the five moments of hand hygiene" or "fifth moment of hand hygiene violated".

Any form of indication to the healthcare professional is acceptable, be it through images, texts or sound.

It is emphasized that the arrangement of the signaling element 16 is not restricted to that shown in FIG. 7; in other embodiments, it could be disposed at the head of the bed that receives the patient, as well as on one of the walls of the surgical center, such as near the door or alcohol gel dispensers.

Further, the signaling element 16 could be disposed in the operable device 2 itself, such as in its upper portion, thus being visible to the healthcare professional.

Figure 8:
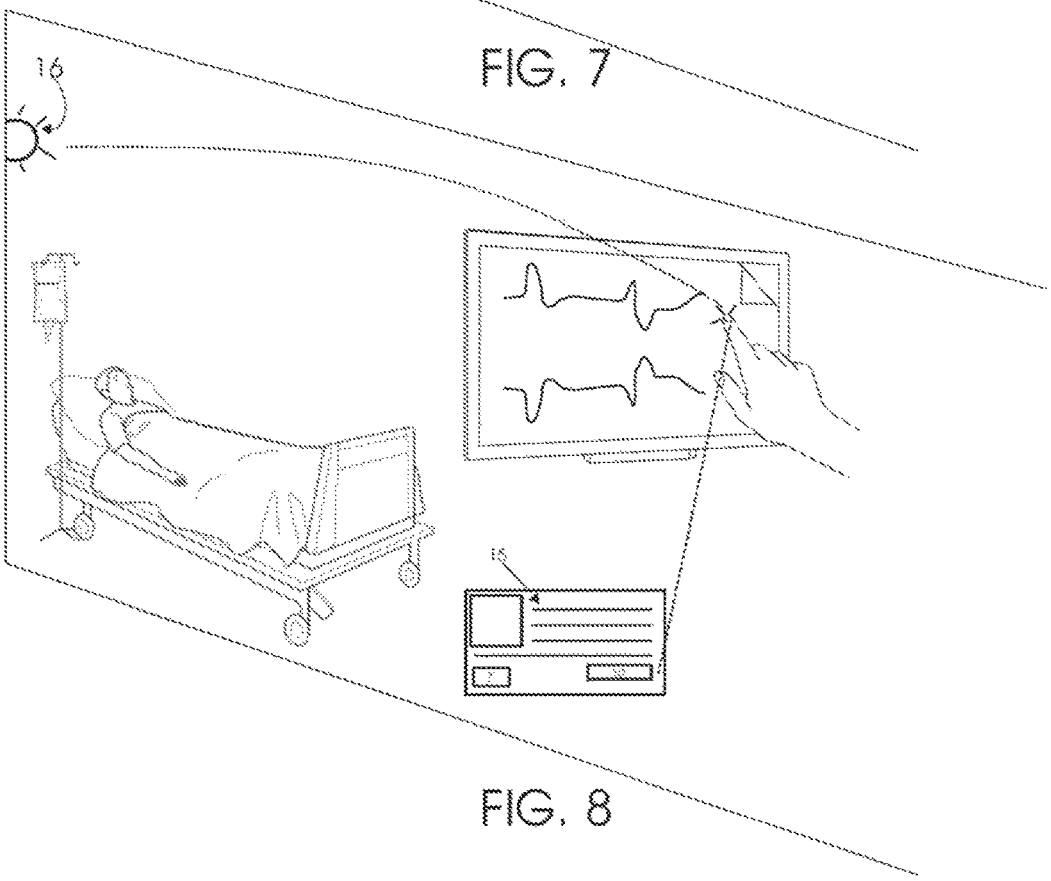
FIG. 8—is a representation, in a flag element and in an identifying element, of the indication of physical contact in the operable device.

In addition, it is emphasized that the perceptible indication may be indicated only on the identifying element 15, as disclosed in FIG. 6, or still only on the signaling element 16, as in FIG. 7, or on both components, such as in the representation of FIG. 8.

Figure 9:
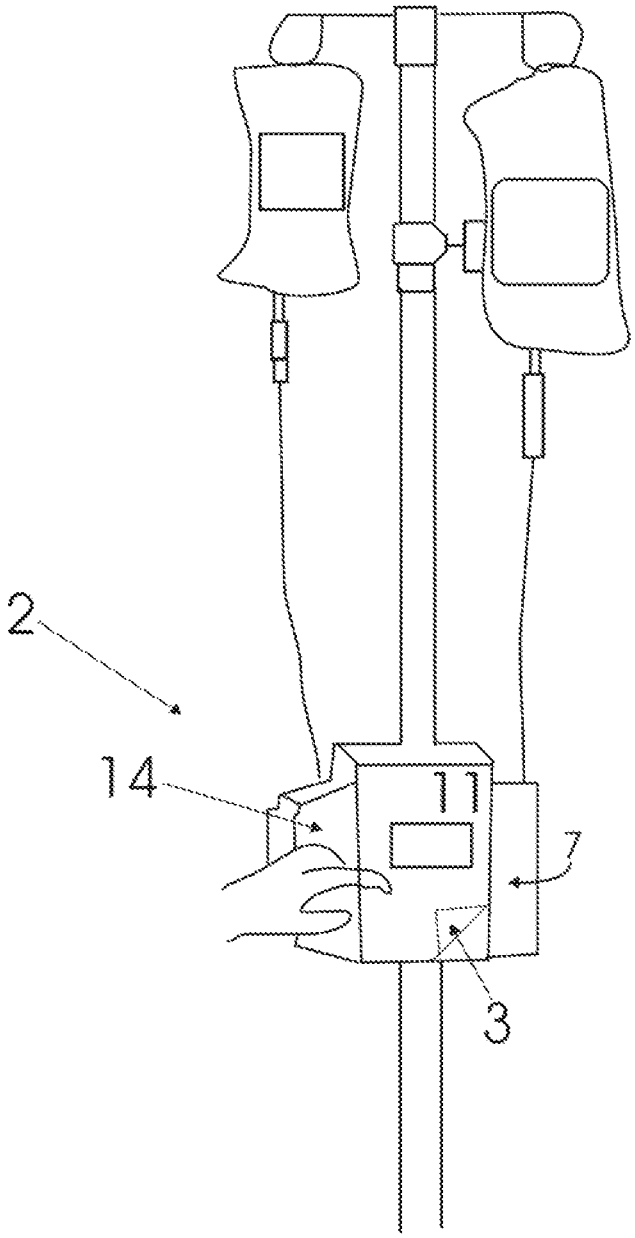
FIG. 9—is a representation of an infusion pump capable of integrating the system proposed in the present invention.
Figure 10:
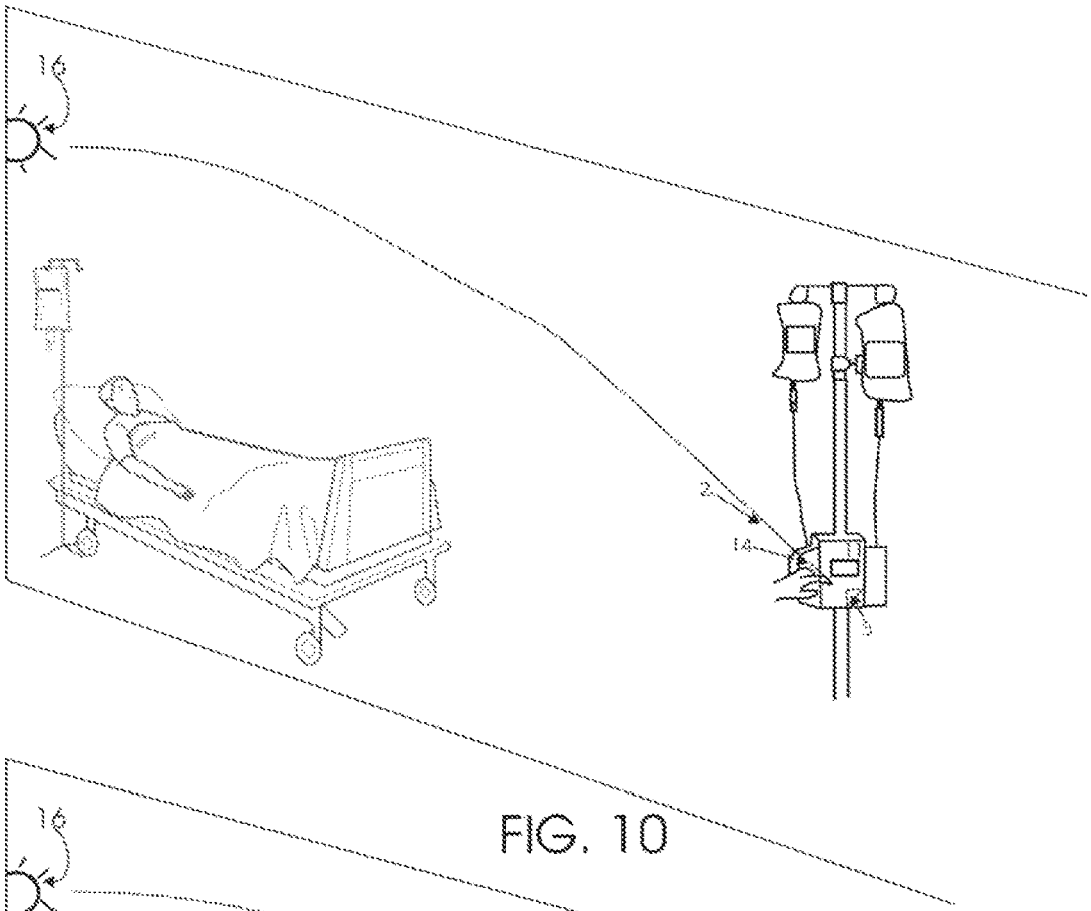
FIG. 10—is a representation, in a flag element, of the indication of physical contact in the operable device.

In an alternative embodiment of the system 1 proposed in the present invention, this system may be applied to an infusion pump 14 of a hospital environment, such as in the representation of FIG. 9. Preferably, the infusion pump 14 operates without the need of touching its surface 11.

Thus, it is understood that in the configuration shown in FIG. 9 the operable device 2 should be understood as an infusion pump 14, provided with the touch sensor 3 and able to detect any physical contacts on the surface 11 of the pump 14.

Figure 11:
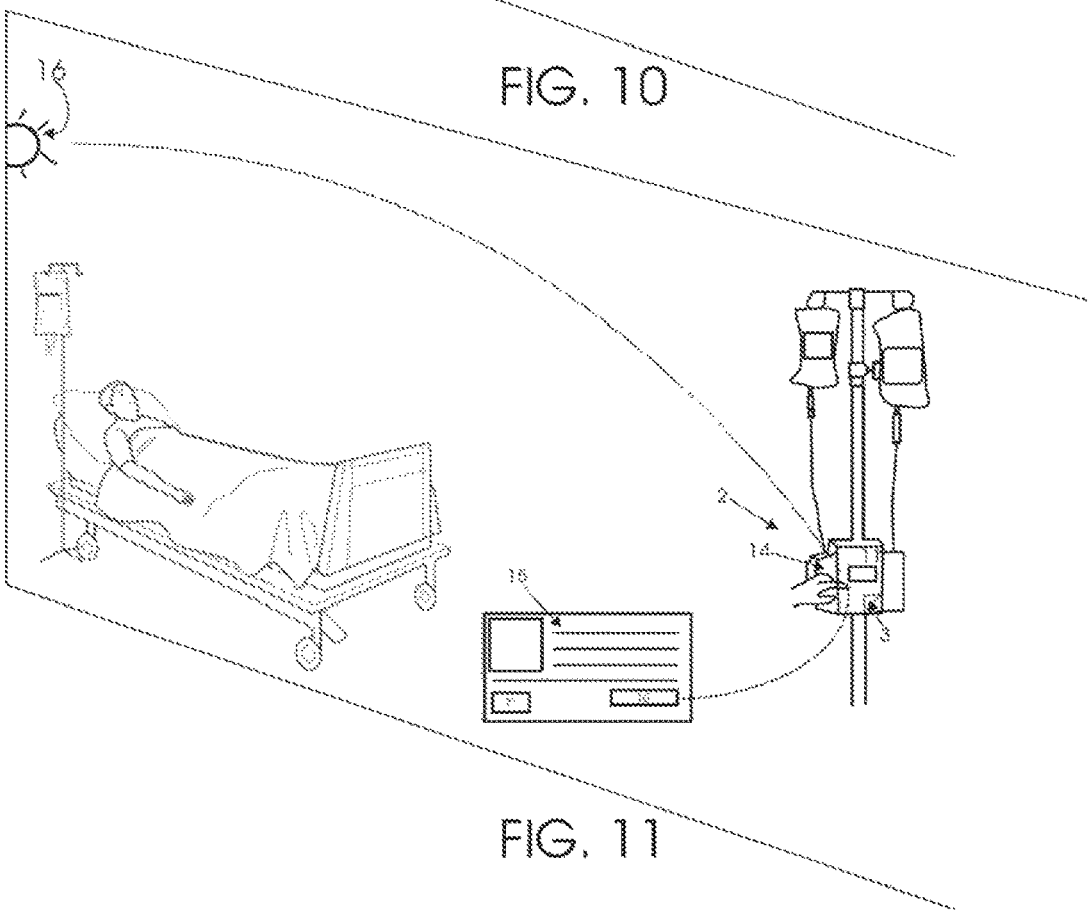
FIG. 11—is a representation, in a flag element and in an identifying element, of the indication of physical contact in the operable device.

The operation of the system 1 when applied to the infusion pump 14 is similar to that already described for its application in a monitor 13, being able to detect physical contacts on the surface 11 of the pump 14, as well as to indicate them by means of a perceptible indication 10, either on the signaling element 16 (FIG. 6) or in the identifying element 15 (FIG. 11), as well as in the combination thereof. The arrangement of the signaling element 16 in the infusion pump itself would also be acceptable.

In a further alternative configuration of the system 1 proposed in the present invention, the operable device 2 may correspond to an information terminal 17 of a hospital environment. More specifically, the information terminal 17 represents, for example, an information terminal to be used and/or viewed by a visitor of the hospital environment.

The information terminal 17 may, for example, indicate information about practices performed in the hospital environment in question, as well as provide information about prevention and care of diseases, surgeries, or may provide information to make visitors aware of hand hygiene practices.

Further, the information terminal 17 of this alternative configuration of the system 1 is preferably an information terminal which does not require the occurrence of touches on its surface 11 to operate, thus it is understood that the information terminal is a touchless terminal.

Thus, it is understood that in this alternative configuration of the system 1 proposed in the present invention the passer-by of the hospital environment corresponds to a hospital visitor and that views the information terminal 17.

Figure 12:
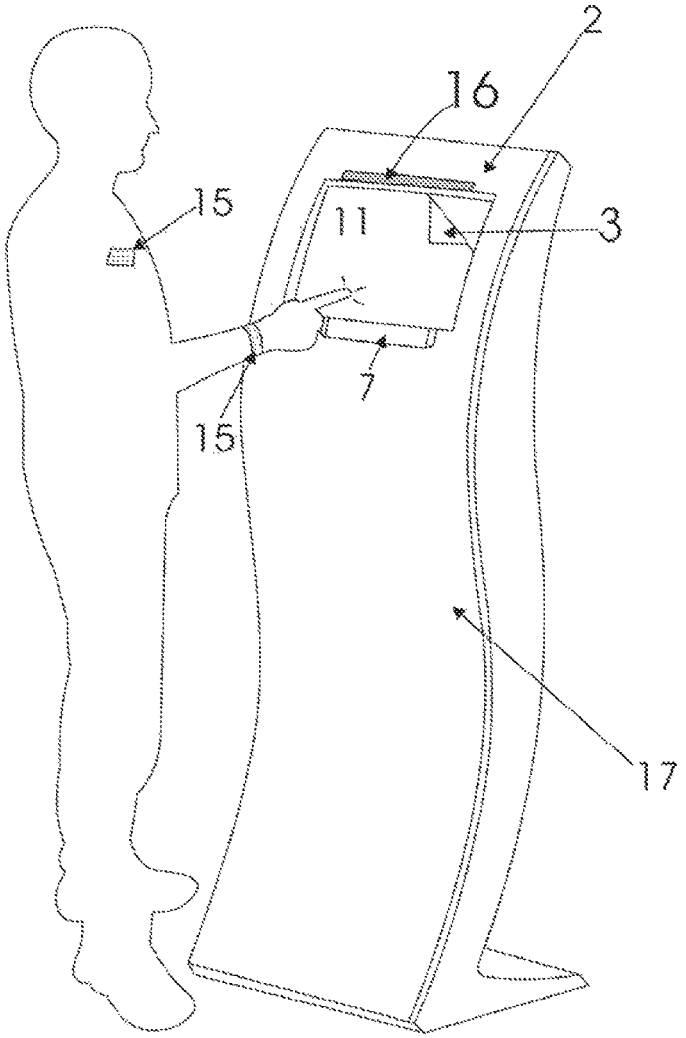
FIG. 12—is a representation of an alternate configuration of the present invention, wherein the operable device configures an informational terminal.

Similarly to the description already made for the system 1 when it is applied to monitors 13 and infusion pumps 14, the system 1 is able to identify the occurrence of physical contacts on the surface 11 of the operable device 2, that is, on the surface 11 of the information terminal 17, as shown in FIG. 12.

In addition, the operable device 2 of this alternative configuration of the present invention further comprises a first identifying sensor 7, as already discussed above, when applying the system 1 to monitors 13 and infusion pumps 14.

Moreover, even when used in information terminals 17, the system 1 is able to generate an event statement 8 and a consolidated event log 8' related to the occurrence of touching on the surface 11 of the terminal 17.

As shown in FIG. 4, the event log 8 may contain a first field A referring to a brief description of the operable device 2, such as "informational terminal of block A—maternity", a second field B referring to the description of the touch event occurred, such as touch 1, touch 2, a third field C referring to the indication of the visitor who made such a touch, such indication being, for example, nominal or by code of registration made when entering the hospital environment, and a fourth field D referring to the date and time the physical contact occurred.

Figure 5:
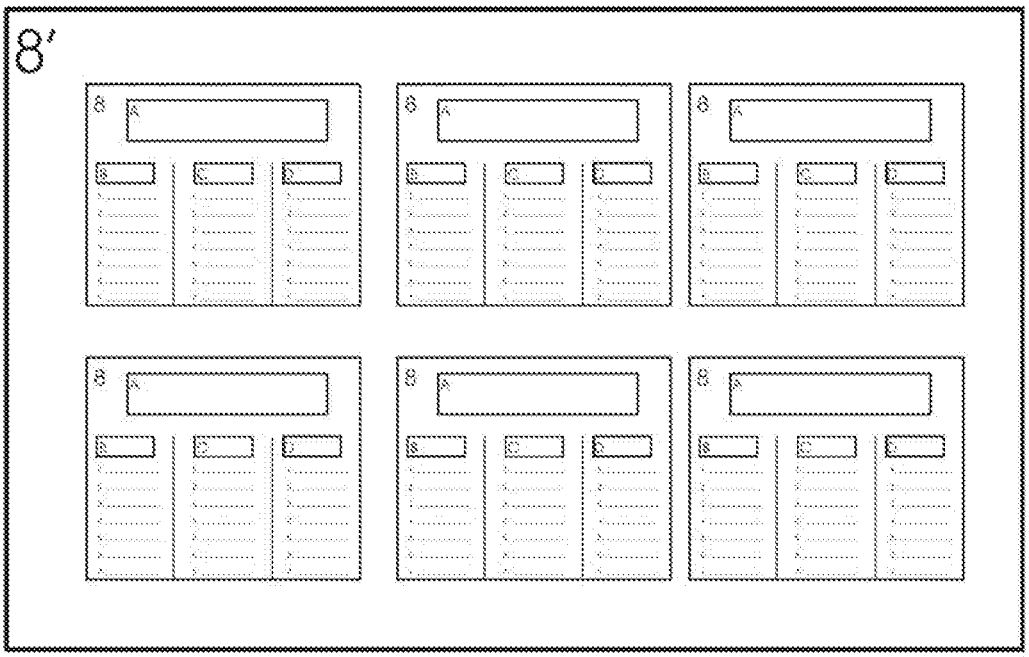
FIG. 5—is a representation of the consolidated event log generated from the occurrence of physical contact on the surface of the operable device.

Additionally, and as shown in FIG. 5, it is further possible to generate a consolidated event log 8 corresponding to all operable devices 2 of a hospital environment.

Upon application of the system 1 to information terminals 17, each occurrence of physical contact on the surface 11 of the terminal 11 will generate a perceptible indication 10 to the passerby of the hospital environment. In other words, and considering this configuration of the system 1, each touching on the surface 11 of the information terminal 17 will generate a perceptible indication 10 to the hospital visitor.

Thus, and as depicted in FIG. 12, the perceptible indication 10 may be generated on an identifying element 15 of the passer-by in the hospital environment, such as on a wristband, an identification sticker, a badge, or even the itself passer-by's cell phone. If it is desired to identify the visitor who touched the surface 11 of the information terminal 17, the identifier element 15 should comprise a second identification sensor 7' (not shown in FIG. 12).

Alternatively, the perceptible indication 10 may be indicated on a signaling element 16 of the hospital environment, such as preferably via a light representation arranged on the information terminal 17 and which provides the indication to the passer-by that the he/she should sanitize his/her hands. The indication by text or images is also acceptable, as well as its representation in both the identifying element 15 and the signaling element 16.

Figure 13:
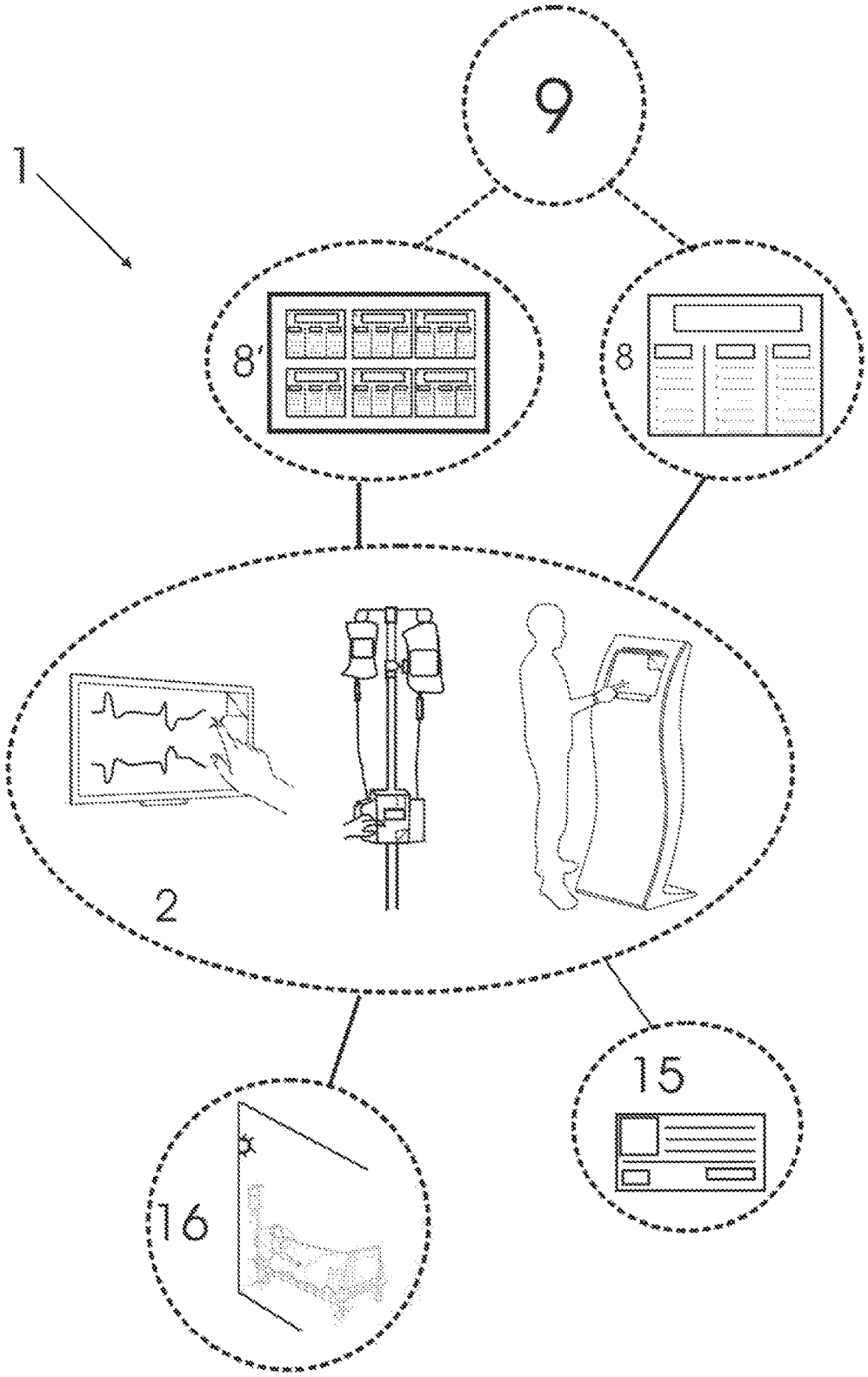
FIG. 13—is a representation of the hand hygiene monitoring system in a hospital environment as proposed in the present invention.

In this way, and as shown in FIG. 13, a monitoring system of physical contact events in a hospital environment 1 is proposed to detect the occurrence of physical contacts on the surface 11 of an operable device 2, such as a monitor 13, an infusion pump 14 and an information terminal 17, thus indicating to the passerby of the hospital environment the need to perform hand hygiene.

Also, system 1 proposed in the present invention further comprises an electronic control, such as a microprocessor associated with the operable device 2 and able to perform the characteristics described for system 1.

It should be noted that the description of system 1 proposed in the present invention and referring to its use in a monitor 13 (FIG. 2), infusion pump (FIG. 9) and information terminal 17 (FIG. 12) refer only to figure a preferred description of possible operable devices 2 capable of integrating system 1.

As already mentioned above, the description of an operable device 2 may further represent: furniture items of the hospital environment or any object and surfaces arranged in the hospital environment, being close to the patient or not.

Regardless of the operable device 2 considered, and as previously described, it must be provided with the touch sensor element 3, thus being able to detect the occurrence of a physical contact on its surface.

In accordance with the monitoring system of physical contact events in a previously described hospital environment 1, the present invention further describes a method of monitoring physical contact events in a hospital environment.

More specifically, the method comprises the steps of identifying the occurrence of a physical contact on the surface 11 of an operable device 2 and generating at least one of an event log 8 and a consolidated event log 8' at each occurrence of identified physical contact.

The method further comprises the step of generating a perceptible indication 10 to the passerby of the hospital environment at each occurrence of identified touch, wherein the perceptible indication is generated in at least one of an identifying element 15 of the passerby of the hospital environment, a signaling element 16 of the hospital environment or in the operable device 2 itself.

In addition, and in accordance with the above-described system, the perceptible indication 10 indicates to the passerby in the hospital environment the need to perform hand hygiene, wherein said perceptible indication is represented by means of at least one of the following means: images, texts, sounds, lights and vibrating alerts.

In addition, and in accordance with the above-described system, the monitoring method of physical contact events in a hospital environment proposed in the present invention further comprises the step of sending at least one of the event log and the consolidated event log to a hospital environment control center or to a remote device, such as the cellular phone of a healthcare professional.

Finally, it is pointed out that the method proposed in the present invention is capable of performing all the functionalities addressed when describing the monitoring system of physical contact events in a previously described hospital environment.

Accordingly, the present invention describes a system and method for monitoring physical contact events in a hospital environment, more specifically, a system and method preferably applicable to a surgical center and Intensive Care Unit and detecting the occurrence of undue physical contact with a device (such as pumps, monitors, terminals, furniture items, among others), recording such occurrence, as well as history thereof, and indicating to the healthcare professional the need for hand hygiene.

Moreover, the system and method proposed in the present invention are applicable to other locations in a hospital environment, being able to detect, for example, the occurrence of undue physical contact by a hospital visitor to a device, recording such occurrence and the history thereof, and indicating to the visitor the need for hand hygiene.

After one example of a preferred embodiment has been described, it should be understood that the scope of the present invention encompasses other possible embodiments and is limited only by the content of the appended claims, which include their possible equivalents.

The invention claimed is:

1. A monitoring system of physical contact events in a hospital environment comprising:

at least one touchless operable device operable by a passer-by, the touchless operable device comprising a first surface configured as a surface in which an occurrence of a touch is unwanted; and at least one touch detector film associated with the first surface of the touchless operable device, the touch detector film comprising at least one touch sensor disposed on a surface of the touch detector film, the touch detector film being associated to the first surface of the touchless operable device by an adhesive element, and the touch detector film being configured as a pellicle which is disposed over the first surface of the touchless operable device, and the touch sensor being configured as at least one of a capacitive touch sensor or a resistive touch sensor, the system being configured to identify an occurrence of a touch by the passer-by on the touch detector film, and the occurrence of the touch on the touch detector film generating a perceptible indication to the passer-by in the hospital environment, the perceptible indication indicating to the passer-by that the passer-by should sanitize the passer-by's hands.

2. The system according to claim 1, wherein the system further comprises a first identifying sensor associated with the touchless operable device and the touch sensor.

3. The system according to claim 2, wherein each occurrence of a touch on the surface of the touchless operable device generates at least one of an event log and a consolidated event log received by a control center.

4. The system according to claim 2, wherein the system further comprises a second identifying sensor associated with the passer-by in the hospital environment, the second identifying sensor compatible with the first identifying sensor.

5. The system according to claim 1, wherein the perceptible indication generated at each occurrence of a touch is indicated in at least one of an identifying element of the passer-by in the hospital environment and a signaling element of the hospital environment.

6. The system according to claim 5, wherein the perceptible indication is indicated on the touchless operable device of the hospital environment.

7. The system according to claim 6, wherein the perceptible indication is represented by means of at least one of the following means: images, texts, sounds, lights and vibrating alerts.

8. The system according to claim 1, wherein the touchless operable device is selected from the group consisting of terminals, pumps and monitors.

9. The system according to claim 8, wherein the touchless operable device corresponds to at least one of a monitor, an infusion pump and an information terminal.

10. The system according to claim 9, wherein the touchless operable device is associated with an electronic control, the electronic control configured to generate an event log, a consolidated event log and the perceptible indication.

11. The system according to claim 10, wherein the electronic control is configured to send at least one of the event log and the consolidated event log to a remote device.

12. A method of monitoring physical contact events in a hospital environment, the method comprising the steps of:

associating a touch detector film with a first surface of a touchless operable device operable by a passer-by, the first surface being configured as a surface in which an occurrence of a touch is unwanted, the touch detector film comprising at least one touch sensor disposed on a surface of the touch detector film, the touch sensor being configured as at least one of a capacitive touch sensor or a resistive touch sensor, the touch detector film being associated to the first surface by an adhesive element, and the touch detector film being configured as a pellicle which is disposed over the first surface of the touchless operable device;

identifying an occurrence of a touch by the passer-by on the touch detector film;

generating a perceptible indication to the passer-by due to the occurrence of the touch in the touch detector film, the perceptible indication indicating to the passer-by that the passer-by should sanitize the passer-by's hands; and generating an event log at each occurrence of touch identified.

13. The method, according to claim 12, wherein the method further comprises the steps of:

generating a consolidated event log at each occurrence of touch identified; and sending at least one of the event log and the consolidated event log to a control center of the hospital environment.

14. The method, according to claim 13, wherein the perceptible indication is generated in at least one of an identifying element of the passer-by in the hospital environment and a signaling element of the hospital environment.

15. The method, according to claim 14, wherein the method further comprises the step of:

generating the perceptible indication in the touchless operable device itself of the hospital environment.

16. The method, according to claim 15, wherein:

the perceptible indication indicates to the passer-by in the hospital environment the need to perform hand hygiene.

17. The method, according to claim 16, wherein the perceptible indication is represented by means of at least one of the following means: images, texts, sounds, lights and vibrating alerts.

18. The method, according to claim 17, wherein the method further comprises the step of: sending at least one of the event log and the consolidated event log to a remote device.

* * * * *